United States Patent [19]

Banniza et al.

[11] Patent Number: 4,878,303

[45] Date of Patent: Nov. 7, 1989

[54] SIGN

[76] Inventors: Harry W. Banniza, 314 Ave. I, S.E., Winter Haven, Fla. 33880; Robert D. Bowlin, 1153 Cephia St., Lake Wales, Fla. 33883

[21] Appl. No.: 223,947

[22] Filed: Jul. 25, 1988

[51] Int. Cl.[4] ..... G09F 15/00

[52] U.S. Cl. ..... 40/606; 40/610; 40/601; 40/603

[58] Field of Search ..... 40/601–607, 40/610, 612, 541, 550, 584; 248/157, 161, 163.1, 163.2, 165, 431, 432, 435, 413, 530; 211/182, 204

[56] References Cited

U.S. PATENT DOCUMENTS

| | | | |
|---|---|---|---|
| 805,524 | 11/1905 | Bryant | 248/163.1 |
| 1,144,726 | 6/1915 | Robinson et al. | 246/165 |
| 1,406,916 | 2/1922 | Arnold | 40/606 |
| 1,656,150 | 10/1926 | Little | 40/606 |
| 1,756,389 | 4/1930 | Schneider | 248/163.2 |
| 2,559,302 | 7/1951 | Louft | 40/607 |
| 2,612,695 | 10/1952 | Schneider et al. | 248/413 |
| 4,019,271 | 4/1977 | Latimer | 40/607 |

*Primary Examiner*—Richard J. Apley
*Assistant Examiner*—J. Welsh
*Attorney, Agent, or Firm*—William M. Hobby, III

[57] ABSTRACT

A portable sign apparatus has a changeable display and includes a frame having a pair of vertical frame members and a pair of horizontal frame members attached to the vertical frame members. A display portion is removably attached to the frame between the horizontal frame members. A ground support base is attached to the frame to support the frame in an upright position for displaying the display portion and supports the frame at each end thereof with a pair of legs connected to a leg support member. An attaching system allows the frame to be movably attached to the leg support members to allow the frame to be raised and lowered. A ground support attachment provides additional support between the frame and the ground to hold the sign more securely in position.

16 Claims, 2 Drawing Sheets

SIGN

BACKGROUND OF THE INVENTION

The present invention relates to a sign and particularly to a sign having a changeable display and an adjustable frame having supporting legs along with additional support members between the sign and a ground surface.

In the past there have been a wide variety of signs and displays for displaying graphics and indicia to provide passersby with information as well as advertising products and services. A wide variety of signs such as billboards have been made primarily for roadside use and that includes the present invention which displays information as well as graphics to the public passing in the vicinity of the sign. Roadside signs are typically used for advertising or information purposes but may also include educational material. The present sign is more clearly directed towards a portable sign which may be picked up and moved from place to place and may have the display changed from time to time and in particular provides a sturdy support against being knocked or blown over.

Prior U.S. Patents which show signs which may be readily moved include the Pulver, Jr. U.S. Pat. No.: 2,388,180, for a changeable price sign for a gasoline station or the like which includes a frame and supporting face portion formed of pairs of legs and the Little U.S. Pat. No.: 1,656,150, for a sign supporting frame similar to the Pulver patent but with a different shaped frame and a different leg supporting system. The Schneider U.S. Pat. No.: 1,756,389, shows a similar sign supporting frame with a metal framework and a base forming supporting feet on either side. In the U.S Patent to Doublet U.S. Pat. No.: 4,647,016, a safety barrier and a method of manufacturing a safety barrier is illustrated having a metal framework with spaced bars and pairs of supporting feet on either end to support the barrier.

The present invention is similar to the prior art with the metal frame and supporting legs and a changeable display but adds additional features which includes ready height adjustment of the supporting framework on the supporting legs along with an additional ground attaching system for firmly holding the sign in place on the ground. Also provided are rapidly changeable decorative elements along with lights and flashing lights. This sign is particularly suitable for rental purposes for displaying custom messages at the request of the customers and is adapted to being customized with a wide variety of accessories that can be readily attached thereto and can be attached to different surfaces on the ground.

SUMMARY OF THE INVENTION

The present invention relates to a sign apparatus which is portable and has a changeable display. The sign has a frame having a pair of vertical frame members and a pair of horizontal frame members attached to the vertical frame members. A display surface is removably attached to the frame between the horizontal frame members for displaying indicia and graphics thereon. A pair of ground support bases are attached to the frame to support the frame in an upright position for displaying the display mounted in the frame. Each of the ground support bases has a pair of legs connected to a leg support member. An attaching system allows the frame to be movably attached to each leg support member and allows the frame to be raised and lowered on the ground support bases. A ground support system is provided for providing additional support between the frame and the ground to thereby hold the sign more securely in position and may include feet mounted on the bottom of the frame and may be made of a resilient material or may include a "U" shaped anchor member for fitting around the bottom horizonal frame member and into the ground surface to anchor the sign to the ground. It may also include spikes fitted to the frame for being pushed into the ground. The frame also has an attaching system for attaching accessories thereto including corner decorations, flags and impellers, as well as balloons for drawing attention to the sign and the display. Finally, a plurality of lights is removably attached to the display means and has a battery and switch located in one end of one frame member. The lights may be flashed by a circuit placed in the battery housing.

BRIEF DESCRIPTION OF THE DRAWINGS

Other objects features and advantages of the present invention will be apparent from the written description and the drawings in which.

DESCRIPTION OF THE PREFERRED EMBODIMENT

Figure 1:
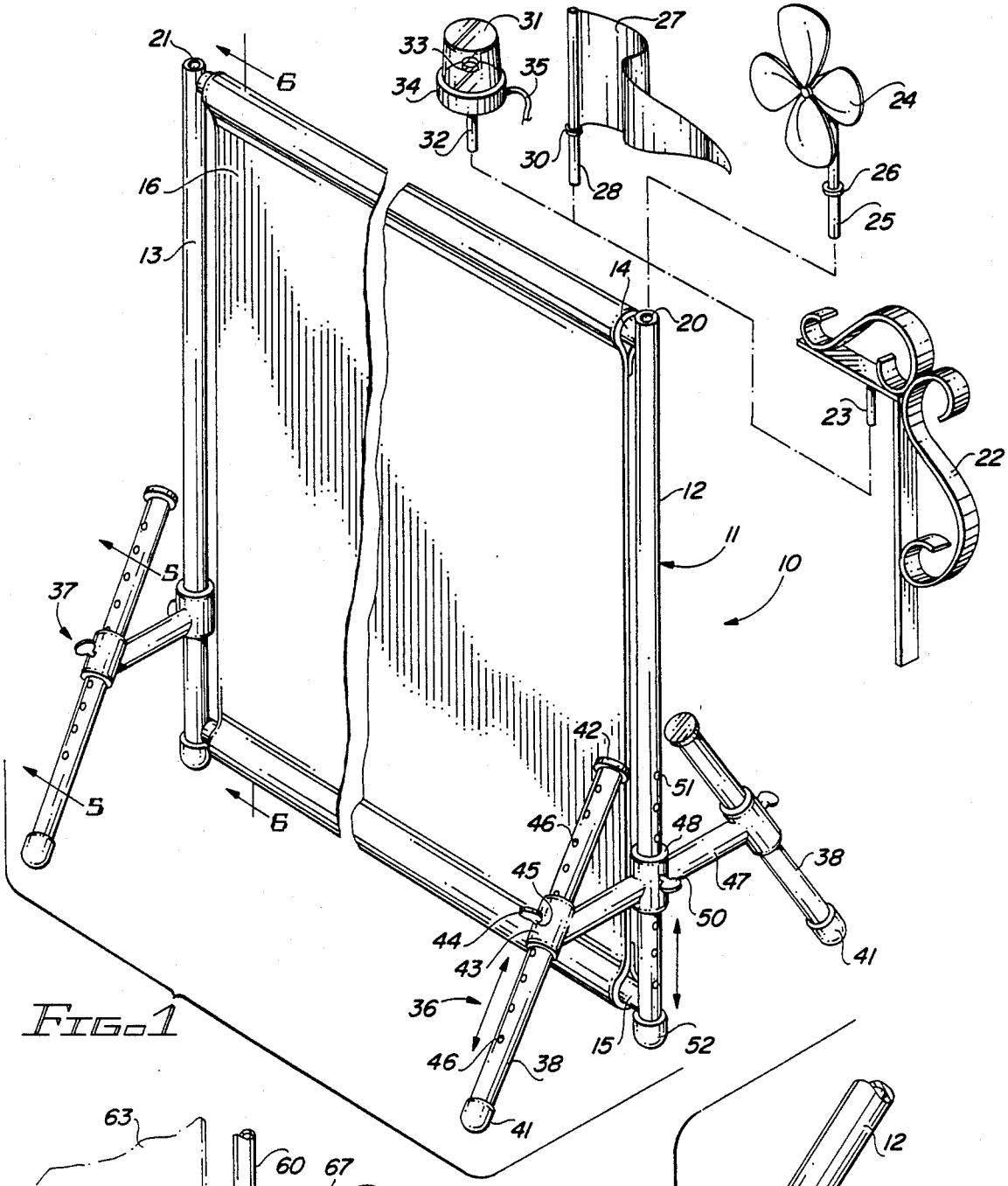
FIG. 1 is a perspective view of a sign having a portion cut away and accessory attachments exploded therefrom.

Referring to the drawings and especially to FIG. 1, a display sign 10 has a framework 11 comprising a pair of vertically extending frame members (or pipes) 12 and 13 and a horizontal pair of extending frame members (or pipes) 14 and 15 connected to the vertical frame members 12 and 13 to form a square or rectangular display frame. A display surface 15 is attached between the horizontal frame member 14 and 15 and can be made of a cloth, paper, plastic or any other material desired and can be attached around the frame with VELCRO strips 17 or can be sewn on if desired or attached in any manner desired without departing from the spirit or scope of the invention. The surface 16 can have custom indicia and graphics placed thereon. The vertically extending frame member 12 has an attaching means or opening 20 while the horizontally extending frame member 13 has an opening 21 for attaching any of a plurality of accessories. A corner decoration member 22 may be attached with a shaft 23 for adding corner decorations to each of the top corners. Alternatively, an eye catching spinner impeller 24 can have an attaching shafts 25 thereon with a stop member 26 for inserting in the openings 20 and 21. A flag 27 can have a press fitted shaft 28 having a stop 30 thereon. Finally, a strobe light 31 can have a press fitted shaft 32 thereon with a strobe bulb 33 therein and a strobe circuit in the casing 34 with the electrical conductor 35 extending therefrom for connection to a power source.

The frame 11 has a pair of supporting bases 36 and 37 supporting the frame 11 thereon. Each supporting base 36 and 37 has a pair of legs 38 and 40, each having a resilient foot 41 and a stop cap 42 thereon and slides in a locking sleeve 43. The locking sleeve 43 has a pin 44 sliding in an opening 45 and into an opening 46 of one of the legs 38 or 40. The sleeve 43 is mounted on the end of a base supporting member 47 and has a vertically extending sleeve 48 in the middle thereof and a locking pin 50 sliding therethrough. The vertical frame members 12 and 13 extend through the sleeves 48 while the pins 50 slide through the sleeve 48 and through the openings 51 to lock the frame 11 in a raised or lowered position as desired for better visibility. The frame may also be lowered until the extending feet 52 abutt the ground. The extending feet 52 may be resilient rubber feet which bump the ground, such as when the sign is being set on a concrete surface to give additional frictional support to the upright sign. The sign needs to be supported in a manner to prevent it from being blown down or moved around and this is accomplished by the wide spread of the legs 38 and 40 along with the rubber feet 41. Sliding the frame 11 until the third legs on each end allows the feet 52 to abutt against a cement surface. However, where the sign can be placed on a softer surface, such as sod or earth, other attachments are also provided for anchoring the sign to the earth.

Figure 2:
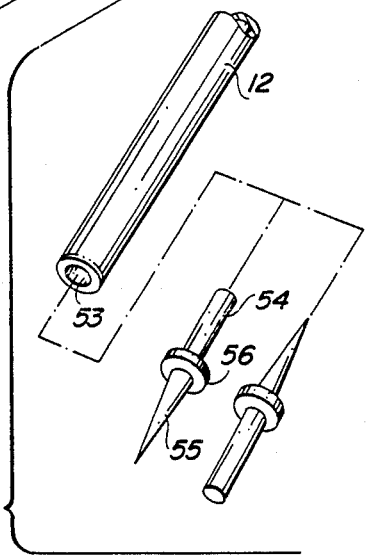
FIG. 2 is a perspective view of one ground attaching system for the sign of FIG. 1.

Turning to FIG. 2, feet 52 can be removed from the end to have the vertically extending frame member 12 have an opening 53 on the bottom thereof for receiving a pressure fitting shaft 54 having a pointed spike 55 and a stop flange 56. When the shaft 54 is inserted in the opening 53 and drive to the stop 56 on both vertical frame members 12 and 13, the frame 11 can be pushed to push the spikes 55 into the earth to anchor the frame to the earth.

Figure 3:
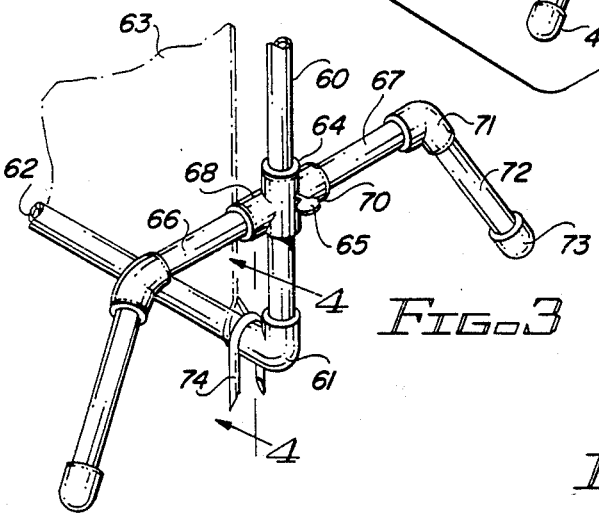
FIG. 3 is a perspective view of a second ground attaching system for the sign of FIG. 1.
Figure 4:
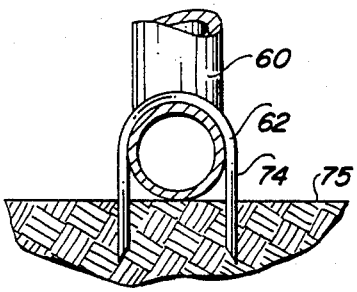
FIG. 4 is a sectional view taken on line 4—4, of FIG. 3.

Turning to FIG. 3, an alternate embodiment is illustrated in which a vertical frame membr 60 is attached with a nailed shaped coupler 61 to a horizontal frame member 62. The horizontal frame member has a display surface 63 attached thereto similar to the embodiment shown in FIG. 1. The vertical frame member 60 slides in a sleeve 64 and can be locked in place with a screw or bolt 65 to allow the vertical frame member 60 to slide up and down. A pair of leg support members 66 and 67 are attached into side sleeves 68 and 70 respectively. Each has an angled coupling 71 having a leg 72 attached thereto with a foot 73 on the end thereof. In this case the vertical frame member 60 is slid in the sleeve 64 until the "L" shaped coupling 61 abuts the ground and an anchoring spike 74 is slid over the horizontal frame member 62 and driven into the earth to anchor the sign to the earth as more clearly illustrated in FIG. 4 with the "U" shaped anchor 74 driven into the earth 75 over the horizontal frame member 62.

Figure 5:
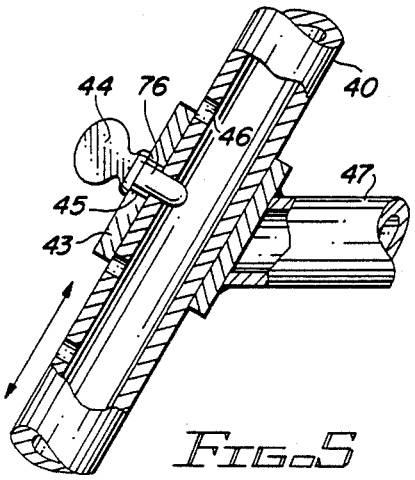
FIG. 5 is a sectional view taken on line 5—5, of FIG. 1.

In FIG. 5 a sectional view shows the pin 44 having a short shaft portion 76 passing through the sleeve 43 and through one of the openings 45 and through the opening 46. A leg 40 is connected to the leg support member 47.

Figure 6:
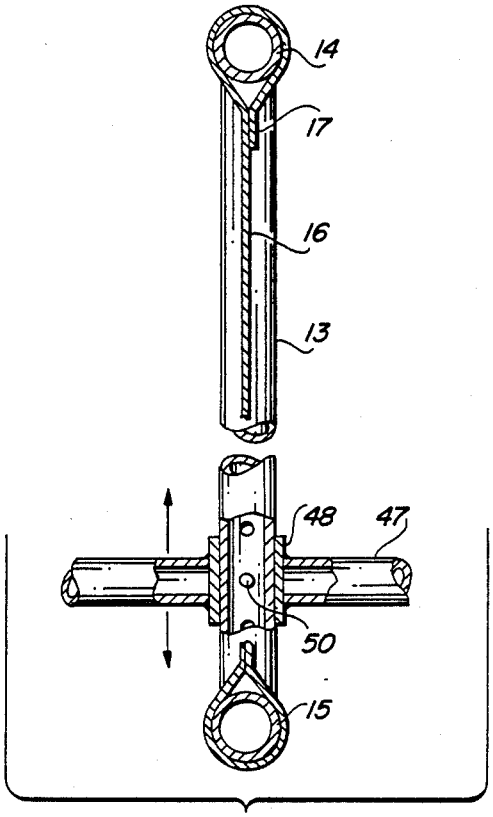
FIG. 6 is a sectional view taken on line 6—6, of FIG. 1.

FIG. 6 illustrates sign having the display material 16 held by VELCRO or hook and loop material 17 around the horizontal frame members 14 and 15. The vertical frame member 13 is illustrated extending through the sleeve 48 with the leg supporting members 47 extending therefrom and having a pin holding the frame in position.

Figure 7:
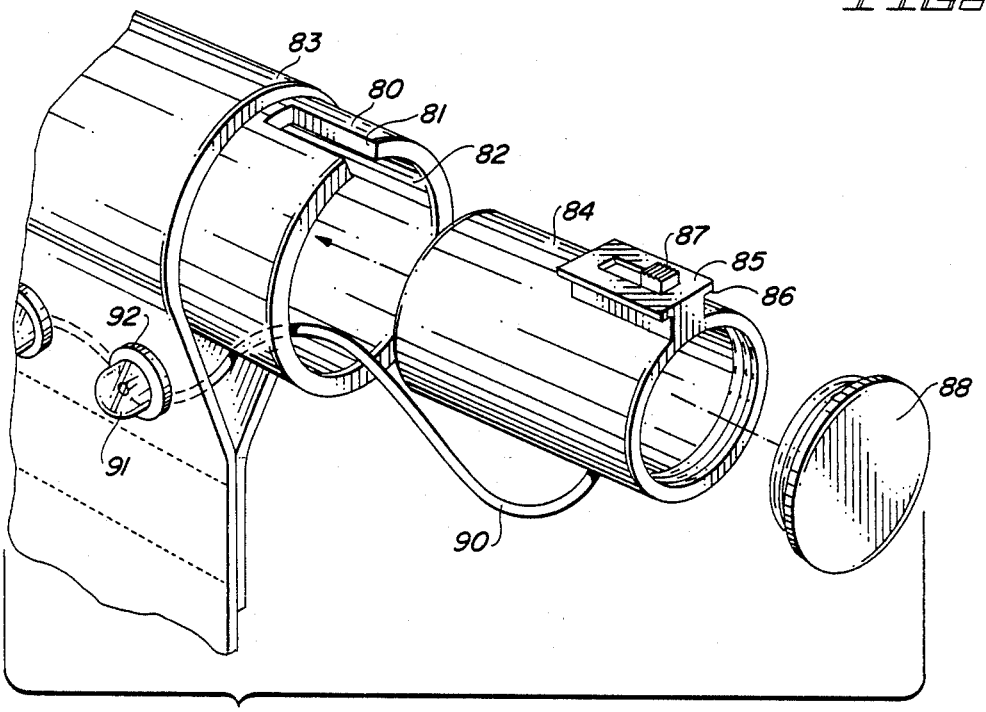
FIG. 7 is a perspective view of an alternate embodiment of a sign having the battery casing switch and lights mounted to the display.

FIG. 7 shows another embodiment in which the horizontal frame member 80 has a slot 81 cut in one end and has an opening 82 in the end thereof. A display surface 83 is connected around the horizontal frame member 80 and a battery and switch casing 84 can have a battery therein and can slide with the protruding switch portion 85 extending into the slot 81 with the slightly flanged area 86 extending thereabove to leave a switch handle member 87 open for turning the lights on and off. The battery casing 84 has a threadable cap 88 for threadedly locking a battery therein and a conductor 90 extending therefrom and connecting a plurality of lamps 91 so that the lamps 91 may be actuated by turning the switch 87 on and off. The lamps 91 are mounted to buttons 92 mounted through the surface of the display material 83. A vibration or oscillating circuit can also be included in the housing 84 if desired to make the lamps 91 blink, or alternatively the lights can be turned on continuously to help light up the sign at night.

It should be clear at this point that several embodiment of a portable, changeable sign have been provided which can be readily moved and anchored to the ground and which can also have the display surface rapidly exchanged and customized for any particular customer and which can be customized with a variety of accessories making the sign adaptable for a wide variety of purposes. However, the present invention is not to be construed as limited to the forms shown which are to be considered illustrative rather than restrictive.

I claim:

1. A portable, changeable sign comprising:

a frame having a pair of vertical frame members and a pair of horizontal frame members attached to said vertical frame members;

display means attached to said frame between said horizontal frame members;

a pair of ground support bases attached to said frame to support said frame in an upright position for displaying said display means, each said ground support base having a pair of legs slidably connected to a support member on opposite sides thereof, whereby said legs can be adjusted for different ground levels;

attaching means for movably attaching each said ground support base to said frame to allow said frame to be raised and lowered; and ground support means for providing additional support between said frame and a surface whereby additional support can be provided between the sign and the surface to thereby hold said sign more securely in position.

2. A portable, changeable sign in accordance with claim 1 in which said ground support means includes a pair of feet formed on the bottom of the vertical frame members of said frame for positioning on the ground for additional support.

3. A portable, changeable sign in accordance with claim 2 in which said ground support means pair of feet includes resilient rubber feet to provide friction with the ground.

4. A portable, changeable sign in accordance with claim 1 in which said ground support means includes at least one "U" shaped anchor member for fitting around one said horizontal frame member and into the ground surface to anchor said sign to the ground.

5. A portable, changeable sign in accordance with claim 4 in which said ground support means includes a pair of "U" shaped anchor members for fitting around one said horizontal frame member and into the ground surface to anchor said sign to the ground.

6. A portable, changeable sign in accordance with claim 1 in which said ground support means includes at least one spike attachable to one of said vertical frame members for extension into the ground surface to anchor said sign to the ground.

7. A portable, changeable sign in accordance with claim 1 in which said frame has accessory attaching means thereon for attaching at least one accessory thereto.

8. A portable, changeable sign in accordance with claim 7 in which said frame has an accessory attaching means for attaching a cornice to one corner of said frame.

9. A portable, changeable sign in accordance with claim 7 in which said frame has an accessory attaching means attaching an impeller thereto.

10. A portable, changeable sign in accordance with claim 7 in which said frame has an accessory attaching means attaching a pair of flags thereto.

11. A portable, changeable sign in accordance with claim 7 in which said frame has an accessory attaching means attaching a light strobe thereto.

12. A portable, changeable sign in accordance with claim 1 in which said display means is a flexible sheet of material attached between said horizontal frame members and having indicia thereon.

13. A portable, changeable sign in accordance with claim 1 in which a plurality of lights are attached to said display means.

14. A portable, changeable sign in accordance with claim 13 in which at least one battery is located in one frame member and said plurality of lights are attached to said battery by a plurality of conductors.

15. A portable, changeable sign in accordance with claim 14 in which a battery case has said battery therein and has a switch thereon for switching said lights on and off.

16. A portable, changeable sign in accordance with claim 15 in which a battery case is mounted in a frame member end portion having a slot there in for said switch to fit into whereby said battery case can be easily attached and removed from said frame member.

* * * * *